US006322088B1

(12) United States Patent
Klamer et al.

(10) Patent No.: US 6,322,088 B1
(45) Date of Patent: Nov. 27, 2001

(54) CONVERTIBLE SKATE

(75) Inventors: Reuben B. Klamer, San Diego; Fernando Pardo, Moorpark; Beatriz E. Pardo, LaJolla, all of CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/327,602

(22) Filed: Jun. 8, 1999

Related U.S. Application Data

(60) Provisional application No. 60/088,599, filed on Jun. 9, 1998.

(51) Int. Cl.[7] ..... A63C 1/00; A63C 17/18

(52) U.S. Cl. ..... 280/11.27; 280/7.1

(58) Field of Search ..... 280/7.1, 11.19, 280/11.22, 11.27

(56) References Cited

U.S. PATENT DOCUMENTS

| | | | |
|---|---|---|---|
| Re. 32,346 | 2/1987 | Klamer et al. | 280/11.2 |
| 177,566 | 5/1876 | Saladee . | |
| 280,236 | 6/1883 | Philips . | |
| 561,798 | 6/1896 | Lawson . | |
| 601,231 | 3/1898 | Blackburn . | |
| 1,173,343 | 2/1916 | Deacon . | |
| 1,188,377 | 6/1916 | Weaver . | |
| 1,309,493 | 7/1919 | Tyler . | |
| 1,527,840 | 2/1925 | Chomin . | |
| 2,035,897 | 3/1936 | Kosanovich . | |
| 2,159,974 | 5/1939 | Lohr . | |
| 2,512,524 | 6/1950 | Gallo, Jr. et al. . | |
| 2,591,534 | 4/1952 | Gallo et al. . | |
| 2,841,408 | 7/1958 | Mariotte . | |
| 3,046,032 | 7/1962 | Humphries . | |
| 3,086,787 | 4/1963 | Wyche . | |
| 3,414,280 | 12/1968 | Ohashi . | |
| 3,649,068 | 3/1972 | Huckenbeck . | |
| 3,891,228 | 6/1975 | Rhinehart et al. . | |
| 3,901,520 | 8/1975 | McMahan . | |
| 3,964,762 | 6/1976 | Adams . | |
| 4,393,620 | 7/1983 | Murakami . | |
| 4,492,385 | 1/1985 | Olson . | |
| 4,526,389 | 7/1985 | Chase . | |
| 4,553,767 | 11/1985 | Robjent et al. . | |
| 4,718,875 | 1/1988 | McKittrick et al. . | |

(List continued on next page.)

FOREIGN PATENT DOCUMENTS

| | | |
|---|---|---|
| 579406 | 9/1976 | (CH) . |
| 716228 | 12/1931 | (FR) . |
| 11025 | 6/1904 | (GB) . |
| 1497546 | 1/1978 | (GB) . |

OTHER PUBLICATIONS

Skates 2 through 6, web site: www.convertibleskates.com, Apr. 18, 2000.

*Primary Examiner*—Brian L. Johnson
*Assistant Examiner*—Joselynn Y. Sliteris
(74) *Attorney, Agent, or Firm*—Morgan, Lewis & Bockius LLP

(57) ABSTRACT

The convertible skate includes wheels that are interchangeable between an in-line configuration and a conventional roller skate configuration. The skate can be readily changed between the different configurations by depressing a first button to release a latch and unlock the front pair of wheels from a first configuration. The front wheels can then be rotated into and locked by the latch at their second configuration. The same type of conversion method and apparatus can be used to convert the rear pair of wheels between different configurations. The skate may also include a reverse spinning brake that prevents the skate from rolling backwards. The reverse spinning brake works in either the in-line configuration or the conventional roller skate configuration without requiring any changeover process between configurations.

21 Claims, 20 Drawing Sheets

U.S. PATENT DOCUMENTS

| | | | | |
|---|---|---|---|---|
| 4,810,229 | | 3/1989 | Shoji . | |
| 4,850,929 | | 7/1989 | Genevey . | |
| 4,932,675 | | 6/1990 | Olson et al. . | |
| 4,932,676 | | 6/1990 | Klamer . | |
| 5,192,099 | * | 3/1993 | Riutta | 280/11.22 |
| 5,193,827 | | 3/1993 | Olson . | |
| 5,295,701 | | 3/1994 | Reiber et al. . | |
| 5,372,534 | | 12/1994 | Levy et al. | 446/457 |
| 5,421,596 | | 6/1995 | Lee . | |
| 5,449,183 | | 9/1995 | Klamer et al. | 280/11.27 |
| 5,494,304 | | 2/1996 | Levy et al. . | |
| 5,513,863 | | 5/1996 | Klamer et al. . | |
| 5,524,911 | | 6/1996 | Cochimin | 280/7.1 |
| 5,620,190 | | 4/1997 | Maggiore | 280/11.21 |
| 5,704,620 | | 1/1998 | Oliemans et al. | 280/11.22 |
| 5,711,539 | * | 1/1998 | Tang | 280/11.27 |
| 5,775,705 | * | 7/1998 | Cochimin | 280/11.27 |
| 5,904,360 | | 5/1999 | Oliemans et al. | 280/11.28 |
| 6,213,479 | * | 4/2001 | Cochimin | 280/7.1 |

* cited by examiner

CONVERTIBLE SKATE

This application claims the benefit of U.S. Provisional patent application No. 60/088,599 filed on Jun. 9, 1998, the disclosure of which is hereby incorporated by reference.

FIELD OF THE INVENTION

The invention relates to a roller skate, and more particularly, to a roller skate that is convertible between an in-line wheel configuration, a conventional quad roller skate wheel configuration and two hybrid wheel configurations. One embodiment of the invention includes a reverse spinning brake mechanism that works in any of the different configurations.

BACKGROUND OF THE INVENTION

Roller skates typically include multiple wheels attached to a sole portion of a skate shoe. Conventional four wheel roller skates have a pair of front rollers sharing one axis of rotation and a pair of rear rollers sharing a second axis of rotation that is parallel to the axis of rotation of the front rollers. Since each roller is transversely displaced from the longitudinal center line of the roller skate, the conventional roller skate inherently provides substantial lateral stability.

In contrast, in-line roller skates typically have multiple wheels arranged in longitudinal alignment along the longitudinal center line of the skate. Each wheel has a unique axis of rotation that is parallel to the axes of rotation of the other wheels. None of the wheels are transversely displaced from the longitudinal center line of the skate. Accordingly, the in-line skate provides less lateral stability than four wheel roller skates.

Providing a skate that has the ability to switch from a conventional four wheel roller skate configuration to an in-line roller skate configuration is desirable for a number of reasons. First, in-line skating is a natural progression from (and more difficult than) conventional four wheel roller skating. Accordingly, for training purposes, a skate that can be converted from a conventional roller skate to an in-line skate facilitates a user's learning of in-line skating while saving the user the cost of purchasing two different types of skates. Second, convertible skates provide increased comfort and security. For example, an average in-line skater faced with a difficult bit of terrain can simply convert the skate from the in-line configuration to the conventional four wheel roller skate configuration to traverse the terrain. Finally, convertible skates are especially appropriate for use by children or other beginning skaters. Convertible skates provide both the training advantages and the comfort and security features that are desired when the skate is used by a child or beginner. In particular, a convertible skate allows a child or beginner initially to learn conventional four wheel roller skating while providing the opportunity to advance to in-line skating if the child or beginner desires. In addition, depending on the type of terrain on which a child will be skating, a parent can determine whether the child should skate in the conventional four wheel roller skating configuration or the in-line skating configuration.

Several convertible skates have been proposed that provide the ability to switch from a plural wheel roller skate configuration to an in-line skate configuration. U.S. Pat. No. 5,524,911 to Cochimin discloses a convertible skate that can be changed from a conventional four wheel skate to an in-line skate configuration. The Cochimin device has two chassis, each of which has two wheels and is rotatable about a post on the bottom sole of the skate. Each wheel is linked by a tie rod to a collar located on the central post. Accordingly, conversion of the skate from a conventional four wheel roller skate to an in-line skate is accomplished by unscrewing a bolt located on the central post to loosen the chassis, and then turning the chassis 90°. The tie rods that are connected between the wheel support and the collar on the central post cause the wheels to turn with respect to the chassis. Accordingly, the wheels' axes of rotation remain perpendicular to the longitudinal axis of the skate when the chassis is turned 90° and into the inline configuration.

Although the Cochimin skate achieves conversion from a conventional roller skate configuration to an in-line skate configuration, the structure necessary to achieve this function is complicated, difficult to operate, and does not adequately lock the axis of rotation of the wheels perpendicular to the longitudinal axis of the skate.

U.S. Pat. No. 5,372,534 to Levy et al. discloses a "variable geometry wheeled conveyance" type of toy vehicle in which two pairs of wheels located at the base of the toy vehicle can be automatically moved from a first configuration to a second configuration. A parallelogram linkage connected to a motor coordinates the movement of the two pairs of wheels in much the same way that the wheels of the Cochimin device are caused to move. In particular, a rack and pinion system rotates two cross links through an angle of 90° to cause wheels located thereon to move from the first configuration to the second configuration. The axes of the wheels located on the cross links remain perpendicular to the longitudinal axis of the conveyance due to their connection to two "tie rods" of the parallelogram linkage. Although the preferred embodiment of the Levy device is a toy vehicle, Levy indicates that the mechanism could be applied to a roller skate. A roller skate that includes the varied geometry wheel disclosed in the Levy patent will inherently include the drawbacks noted above with regard to the Cochimin device because the basic moving linkage and wheel motion of the Levy device is similar to that of Cochimin.

U.S. Pat. No. 5, 449,183 to Klamer et al. discloses an integral multi-function roller skate system that can be converted from an in-line skate to a multi-axis dual wheel conventional skate. As disclosed in the patent, six wheels can be joined together in pairs by a rack and pinion system so that each pair of wheels forms a single larger wheel. Accordingly, the skate is convertible from a conventional multiple wheel roller skate to an in-line skate. However, this design does not provide the same skating characteristics as an in-line skate because pairs of wheels are placed adjacent each other in the in-line skate configuration. Each pair of wheels effectively forms one wide wheel, which does not produce the same skating characteristics as a narrower wheel.

Another desirable feature of an in-line skate adapted for use by children or inexperienced adults is a reverse spinning brake device. By limiting the rotation of one or more wheels to one rotational direction (corresponding to forward movement of the skate), a user can generate propulsion by pushing straight back on the skate. Such a reverse spinning brake lock mechanism allows the user to skate up a sloping travel surface without fear of rolling backwards down the slope.

Many different types of brake locks have been used with conventional roller skates. U.S. Pat. No. 4,932,676 to Klamer discloses a conventional roller skate brake lock design that is configurable between a free wheeling, forward only, or full stop configuration. Each roller skate wheel has gear-like teeth located on an inside cylindrical surface of the wheel. A camming member positions a pawl to selectively engage the gear-like teeth of the wheel and therefore control the movement of the wheel. The pawl extends across the body of the skate to engage a pair of wheels, and the camming member engages the pawl intermediate the wheels. This design is not well suited for use in an in-line skate.

Recently, attempts have been made to implement reverse spinning brake locks on in-line skates. One example of an in-line skate that includes a reverse spinning brake lock is disclosed in U.S. Pat. No. 5,620,190 to Maggiore. The reverse spinning brake lock is described as a movement limiting mechanism and is built into the front roller of the skate. The roller includes ratchet teeth located on an inner circumference of the wheel. The ratchet teeth lock with a tongue to selectively prevent rotation of the wheel. The motion limiting device operates in three modes, including a free wheel mode, a forward only mode, and a full stop mode. Selection between the different modes is accomplished by moving a pawl adjuster into three different positions. In a first position, the pawl adjuster locks the tongue in a location central to the axis of the wheel so that no contact between the wheel and the tongue occurs. In the second position, the pawl adjuster allows the pawl to move vertically. Accordingly, the teeth on the inner surface of the wheel push the pawl vertically away during forward rotation and lock with the pawl when the wheel attempts to spin in a rearward direction, thereby preventing rearward rotation. In a third position, the pawl adjuster locks the pawl in a lowered position with the pawl in permanent engagement with the teeth of the wheel. Accordingly, the wheel is locked and prevented from any forward or rearward movement.

Another in-line skate device that incorporates a reverse spinning brake is sold by Playskool, Inc. of Pawtucket, Rhode Island. The Playskool reverse spinning brake includes a knurled rod located immediately behind the front wheel of the in-line skate. When the front wheel spins in a reverse direction, the knurled rod wedges into a space between the front wheel and a wall that angles down towards the front wheel. The knurled rod effectively brakes the front wheel in the reverse direction. When the front wheel spins in a forward direction, the knurled rod is urged upwards into the opening provided by the angled wall. When the reverse spinning brake feature is not desired, a switch located at the side of the skate moves a lever to lift and lock the knurled rod into the opening provided by the angled wall.

The movement limiting devices discussed above would not accommodate moveable wheels.

SUMMARY OF THE INVENTION

The drawbacks of the prior art are overcome by the present invention, which provides a skate for use by children, beginners, or by experienced skaters that can be readily converted between a conventional four wheel roller skate configuration and an in-line skate configuration one embodiment of which includes a reverse spinning brake operable in both the in-line skate configuration and four wheel skate configuration. The conversion mechanism may be incorporated into either or both pairs of forward and rearward wheels.

In one aspect of the invention, each wheel of the rear and forward pair of wheels is attached to a rotary gear. The rotary gears have an axis of rotation that is perpendicular to the axis of rotation of the wheels. Preferably, the gears are contained within the plane of the sole of the skate, and the gear of each of the forward and rear pairs of wheels interlock with each other such that rotation of one gear causes rotation of the other gear. Consequently, both wheels of each pair move in synchronized fashion when one gear is turned. The physical arrangement of the wheels on the gears is such that the rotational axes of the wheels are collinear at a first gear position (conventional roller skate configuration), and the rotational axes of the wheels are spaced apart and parallel at a second gear position (in-line skate configuration). In this embodiment, the second gear position is rotated 180° with respect to the first gear position and the wheels alternate spinning direction between configurations. Moreover, when converting between the in-line and roller skate configurations the rotary gears are rotated about conversion axes that remain parallel such that wheels, when disposed in initial positions, rotate in a first direction about their respective wheel axes in response to forward movement of the skate, and the wheels, when disposed in final positions, rotate in a second opposite direction in response to forward movement of said skate.

A latch mechanism may be built into the skates to rotationally lock the gears in the first gear position and the second gear position. The latch mechanism includes a push button extending from the bottom sole of the skate which, when pushed, unlocks the gears and permits the pairs of wheels to be rotated from their first gear positions to their second gear positions to convert the skate from a conventional roller skate to an in-line skate.

Because the front and rear wheels may be converted one pair at a time, a skater has the option of converting only one pair of wheels and using the skate in one of two hybrid modes. The hybrid modes retain the benefits of stability provided by a conventional roller skate configuration while developing a sense for the physical challenges presented by an in-line skate.

The reverse spinning brake mechanism may be operable in any skate mode, including the conventional roller skate configuration, the in-line skate configuration, and either of the two hybrid skate configurations. In one aspect of the invention, a knurled bar is provided at the rear of the skate. The knurled bar extends between two vertical channels and is movable vertically with respect to the wheels. When in operation, the knurled bar contacts the rear most wheel (or both wheels of the rear pair when the wheels are in the conventional roller skate configuration) and inhibits the rearward rotation of the wheels. The knurled bar permits forward rotation of the skate because it moves up the channel and out of the way of the wheel(s) when the wheel(s) moves in a forward rotational direction. The conversion mechanism is designed such that the rear most wheel in the in-line configuration and the rear most wheels in the conventional roller skate configuration are located the same distance from the knurled bar. Accordingly, the knurled bar can inhibit reverse rotation in one of the in-line, conventional skate, and hybrid configurations.

The convertible skate of the invention is readily switched between a conventional roller skate and an in-line skate configuration. The change in configuration requires no assembly or disassembly and is simple enough to permit a child to make the switch. In addition, the wheels are securely locked in position in each of the configurations. Further, the conversion mechanism allows improved aesthetic and performance qualities because the conversion mechanism is light weight and vertically compact. The physical arrangement of the wheels on the gears also creates a more accurate in-line configuration than was previously possible for convertible skates because the wheels are closer together in the in-line skating configuration and the width of the wheels does not change between configurations.

The reverse spinning brake mechanism is also readily operable to allow a skater to switch between the free wheeling and forward only modes. In addition, there is no changeover step needed to provide the same reverse spinning brake feature for each of the skate's different configurations because the distance of the rear most wheel from the back of the skate does not change between skate configurations.

DETAILED DESCRIPTION OF PREFERRED EMBODIMENTS

Reference will now be made in detail to a presently preferred embodiment of the invention, examples of which are illustrated in the accompanying drawings. In particular, the invention is directed to a convertible child's skate 1 as shown generally in FIGS. 1–3B.

Figure 1:
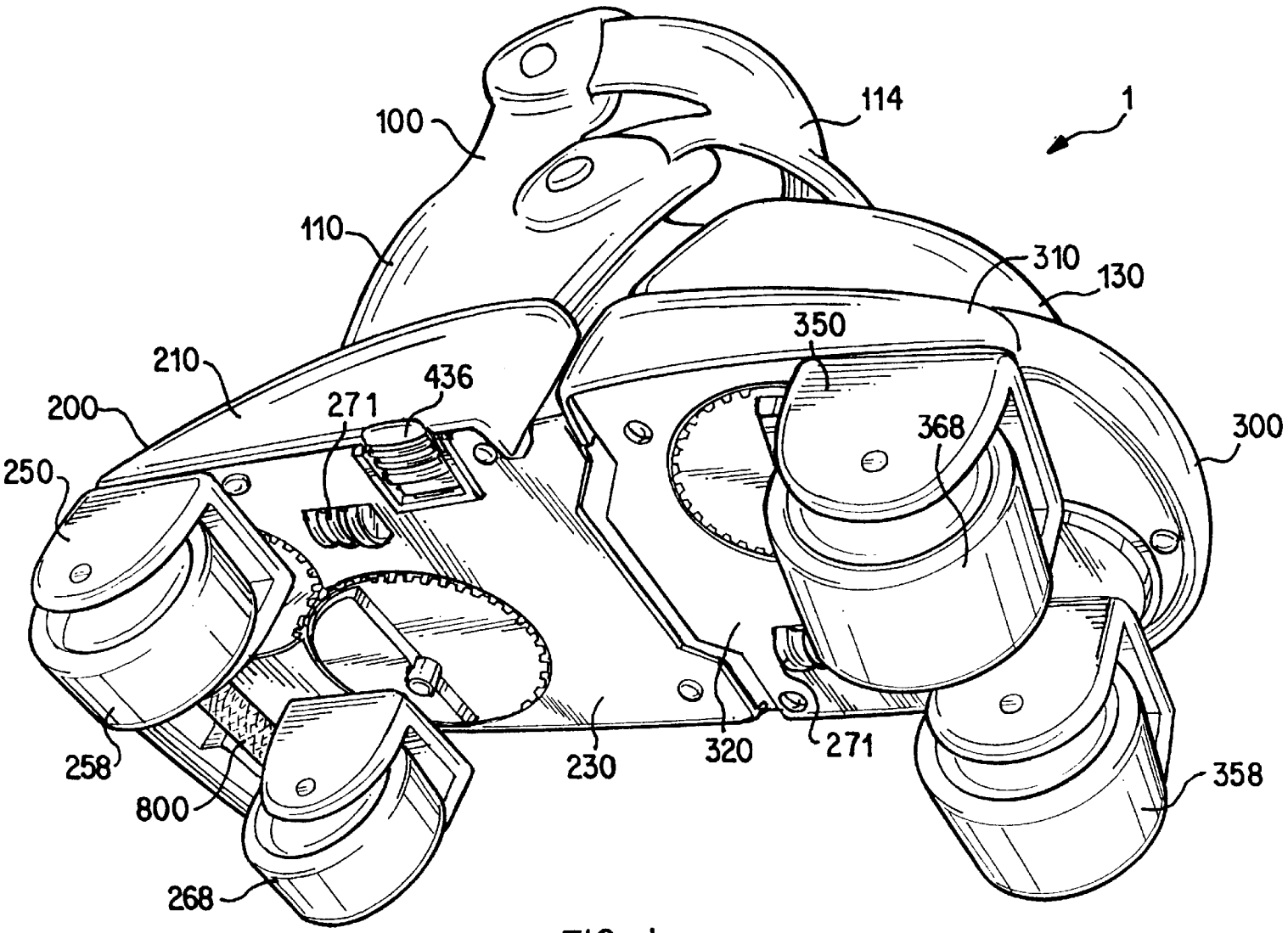
FIGS. 1 and 2 are perspective views of a convertible skate embodying the principles of the invention in conventional roller skate and in-line skate configurations, respectively.
Figure 2:
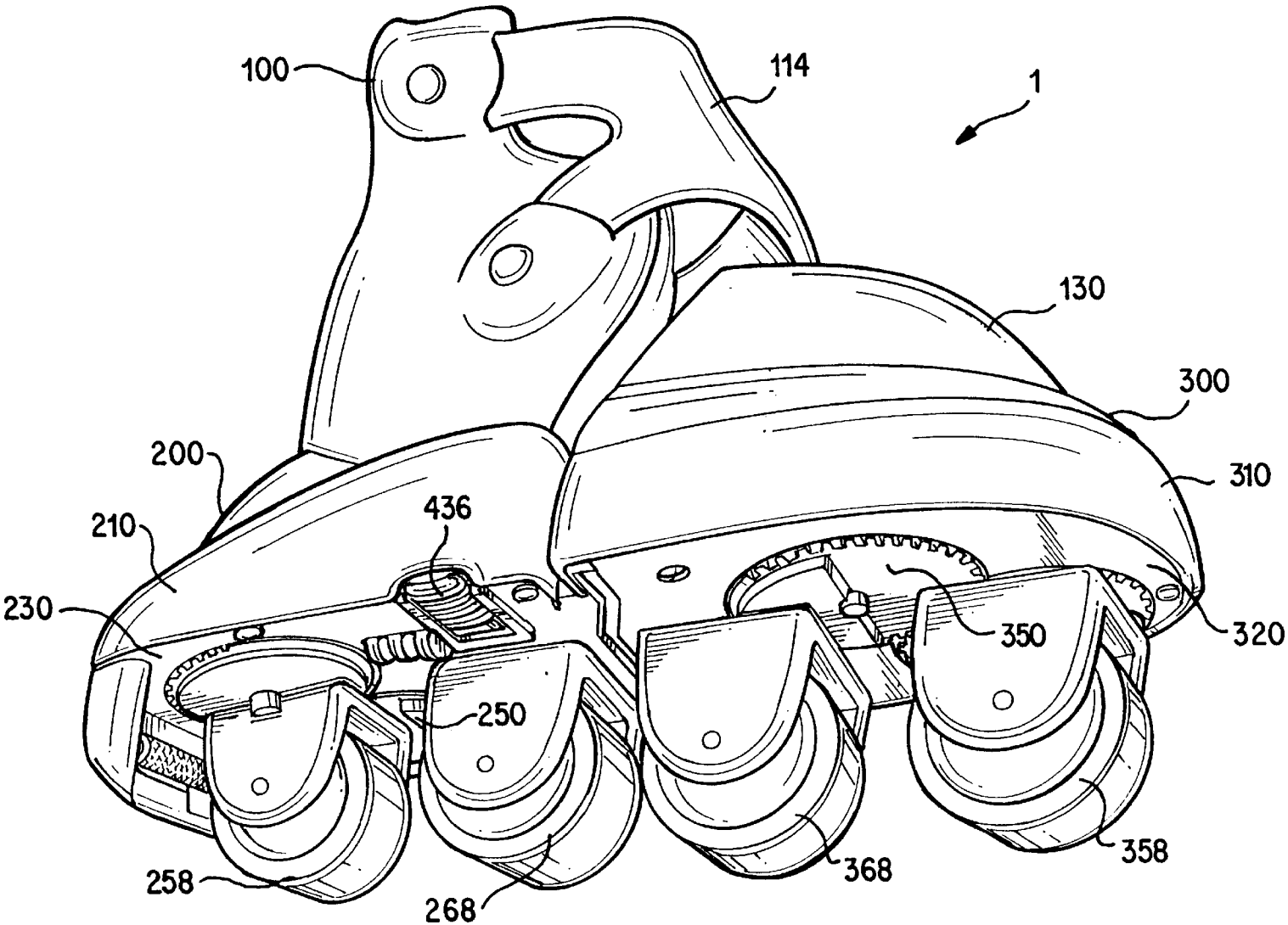

As shown in FIG. 1, convertible skate 1 includes a front assembly 300 and a rear assembly 200. Shoe 100 accommodates the user's foot, and includes heel portion 110 located on the rear assembly and toe cap 130 located on the front assembly. The front and rear assemblies can be moved with respect to each other by length adjustment assembly 400 to accommodate different sized feet. A wheel assembly mounted to the bottom of convertible skate 1 includes front wheel assembly 350 and rear wheel assembly 250, and is configurable between an in-line skate configuration, a conventional roller skate configuration, and two hybrid configurations. A reverse spinning brake assembly 800 is mounted to rear assembly 200.

Figure 3A:
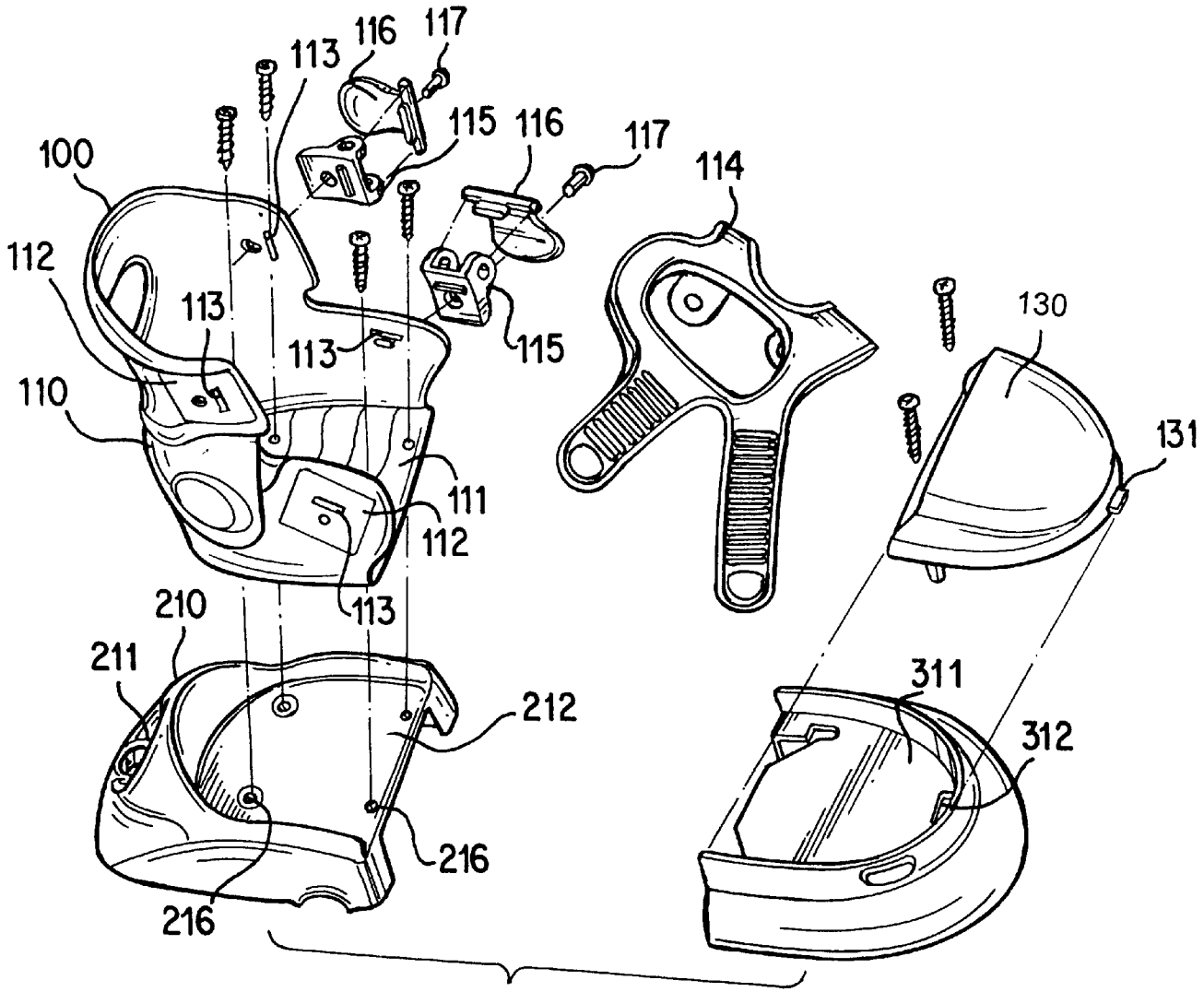
FIGS. 3A–B are exploded views of the upper and lower portions, respectively, of the convertible skate of FIGS. 1 and 2.
Figure 3B:
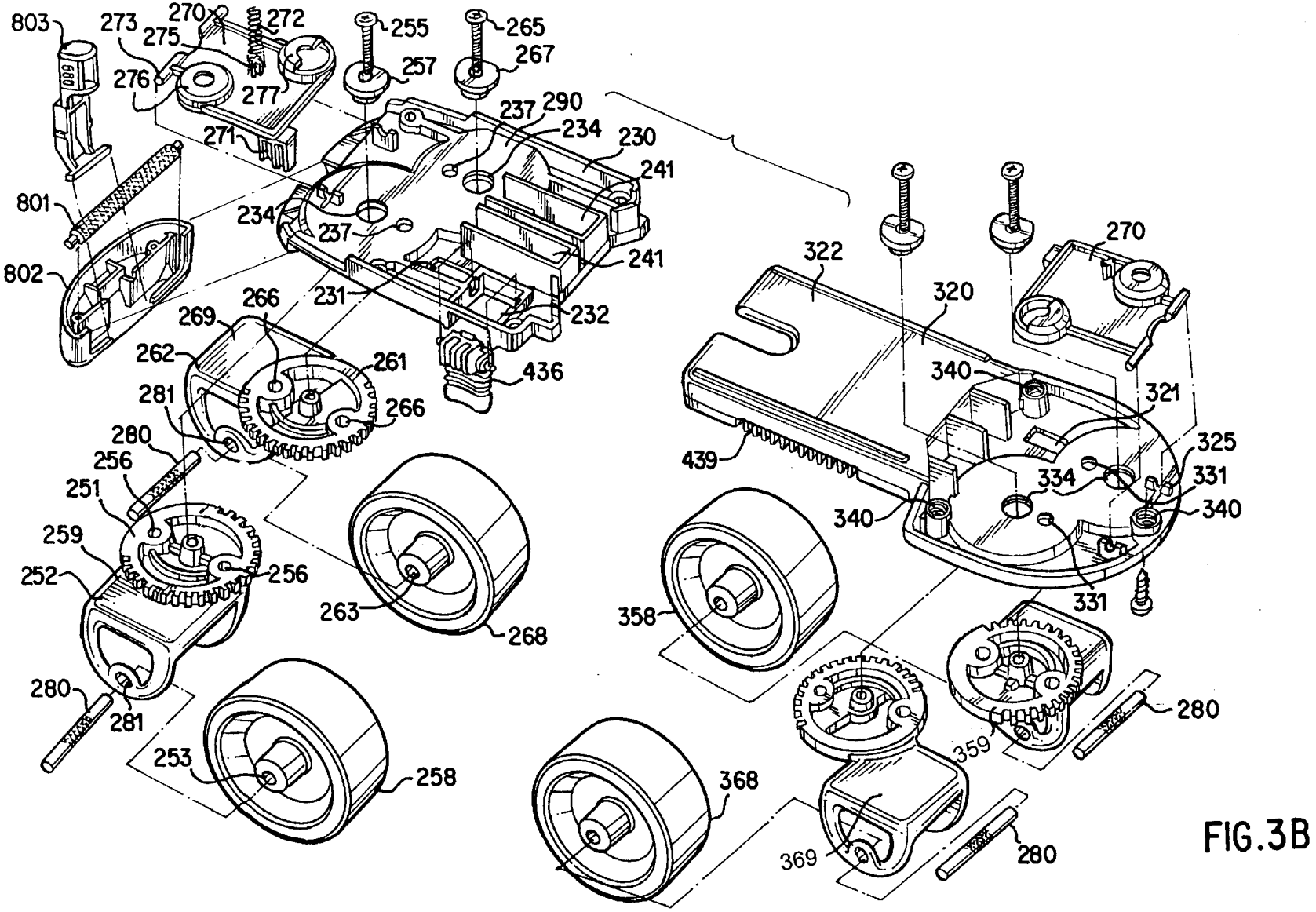
Figure 4:
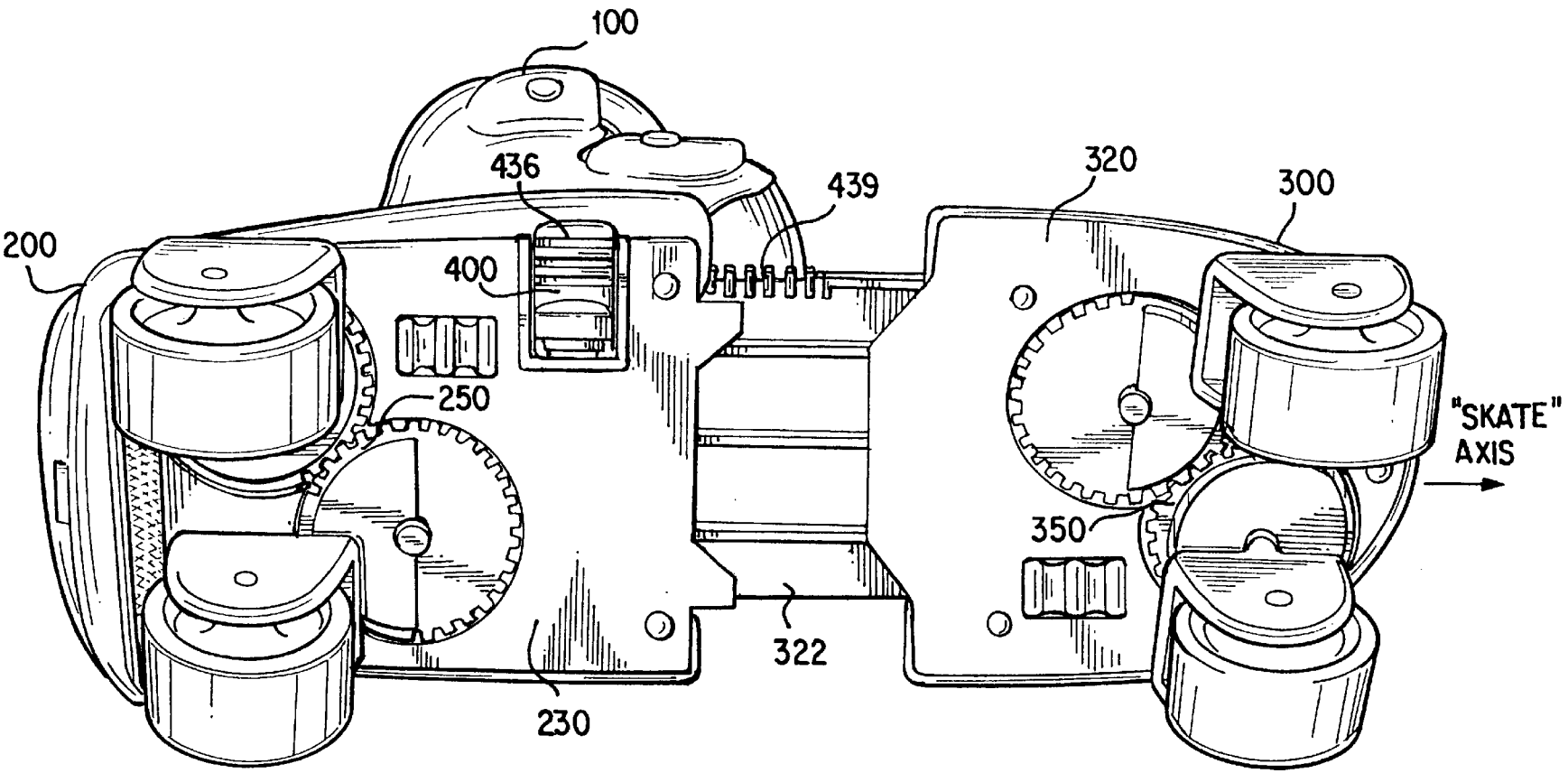
FIG. 4 is a bottom view of the convertible skate of FIGS. 1 and 2 in the conventional roller skate configuration, with the front assembly filly extended from the rear assembly.
Figure 5A:
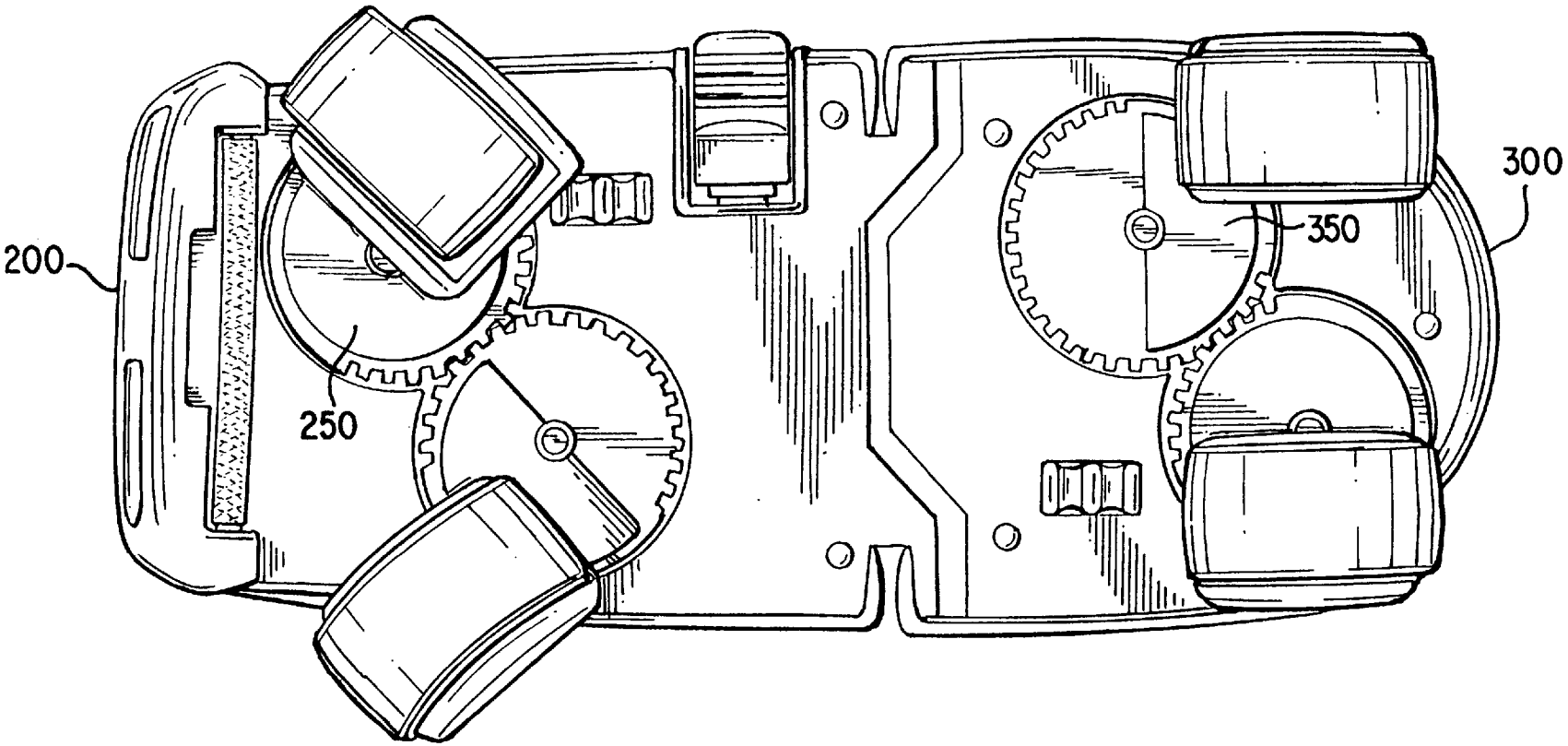
FIGS. 5A–C are bottom views of the convertible skate of FIGS. 1 and 2 showing the conversion of the rear wheels from the conventional roller skate configuration to the in-line skate configuration, in a hybrid skate configuration, and in the in-line skate configuration, respectively.
Figure 5B:
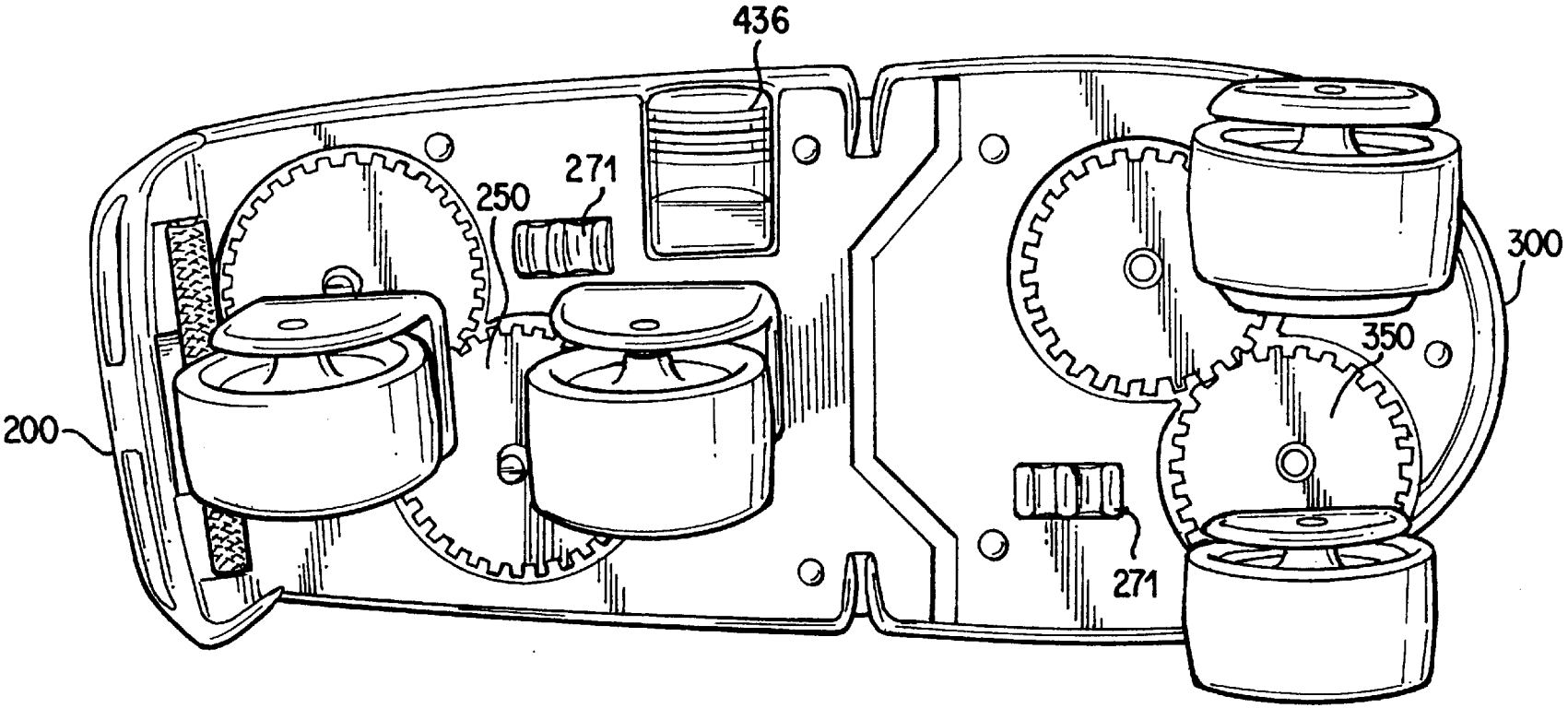
Figure 5C:
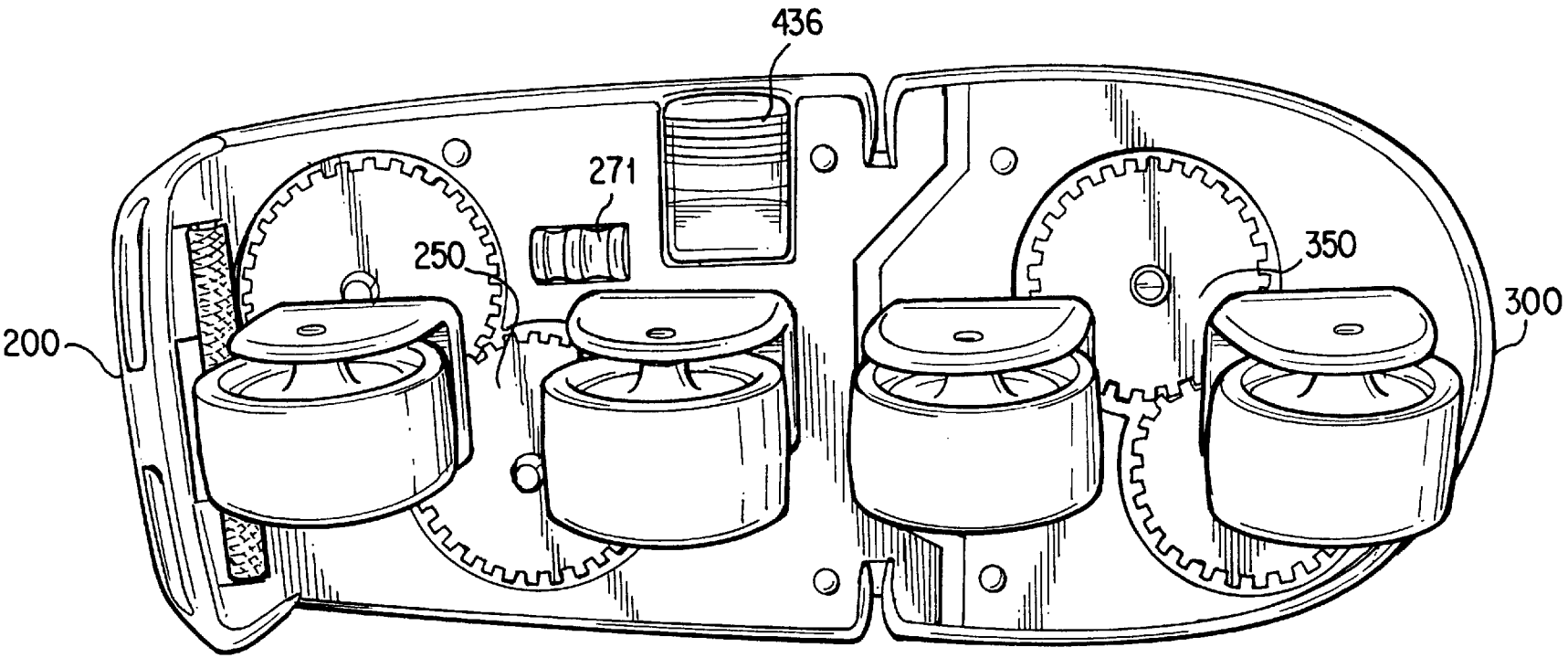
Figure 6:
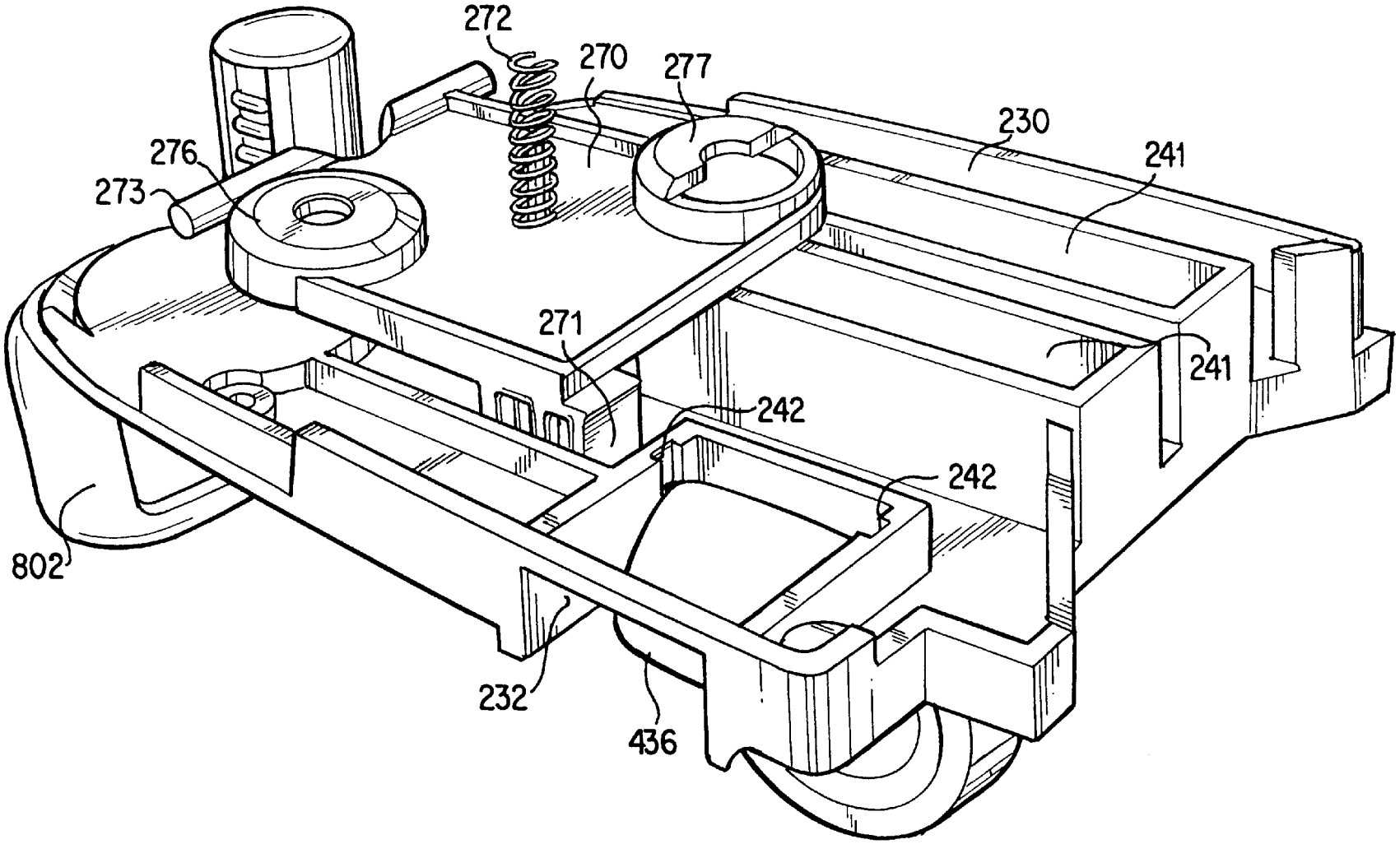
FIG. 6 is a perspective view of the latch and rear assembly lower housing shown in FIG. 3B.

FIGS. 3A–B show exploded assembly views of the upper and lower portions of convertible skate 1. Rear assembly 200 includes a rear assembly upper housing 210 and a rear assembly lower housing 230. Rear assembly 200 and front assembly 300 are very similar in structure and function. Rear assembly 200 will therefore be described in detail, while front assembly 300 will be described in more summary fashion.

Rear assembly upper housing 210 and rear assembly lower housing 230 connect to form between them a rear assembly cavity 290. A rear wheel latch 270, disposed in rear assembly cavity 290, locks rear wheel assembly 250 in either of the in-line and conventional roller skate configurations. Rear assembly lower housing 230 includes a wheel latch aperture 231 to provide a user access to a latch control button 271 of rear wheel latch 270. A shoe platform 212 located on the top surface of the rear assembly upper housing 210 provides a connective surface for the shoe heel portion 110. Rear assembly upper housing 210 also includes a throughway 211 to accommodate the brake lock lever of reverse spinning brake assembly 800.

Length adjustment mechanism 400 permits the rear assembly 200 to be moved relative to the front assembly 300 and fixed in a selected relative position. As shown in FIGS. 7A–B and 17A–B, the length adjustment mechanism 400 includes channels 241 extending from rear assembly lower housing 230 and cooperating with channel limits 328 and channel walls 327 on front assembly lower housing 320. Channel limits 328 slide in the channels 241 when the skate is being lengthened and contact the ends of the channels 241 to prevent the front assembly 300 from being pulled apart and separated from the rear assembly 200 during length adjustment. A length lock 436 provided in a length lock opening 232 of the rear assembly lower housing 230 has teeth 435 that mate with housing teeth 439 located on a side of a lengthening extension 322 of the front assembly lower housing 320. The length lock 436 also has pivot pins 434 that can be located within pivot enclosures 242 in the length lock opening 232 such that the length lock can be pivoted to lock or release the length lock teeth 435 and housing teeth 439. Thus, when the length lock 436 is pivoted open and the teeth are released, rear assembly 200 can be slid to a selected position with respect to the front assembly 300. The assemblies can then be locked together in the selected position by pivoting and closing the length lock 436 to lock the length lock teeth and housing teeth.

Figure 7A:
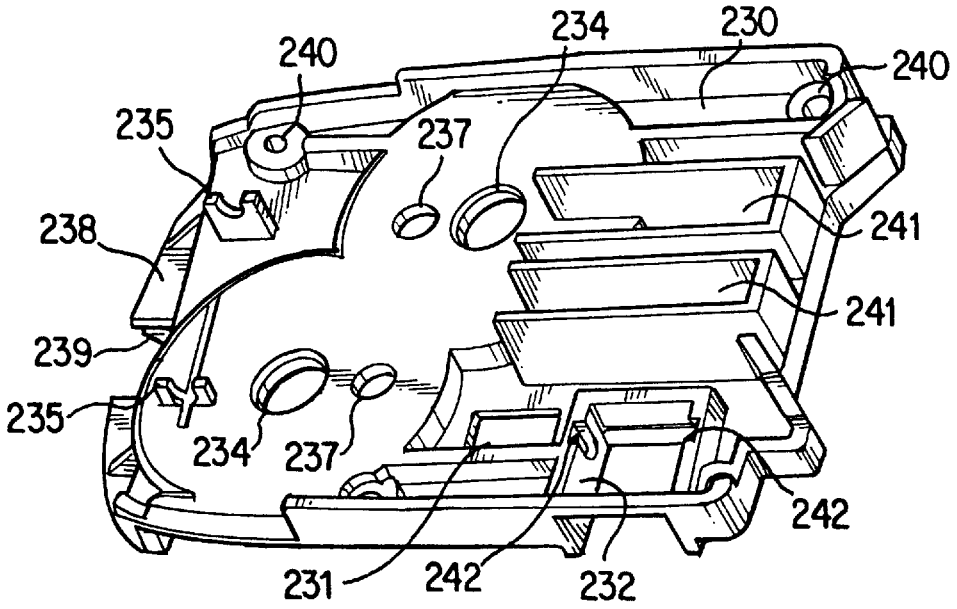
FIGS. 7A and B are top and bottom perspective views of the rear assembly lower housing shown in FIG. 6 respectively.
Figure 7B:
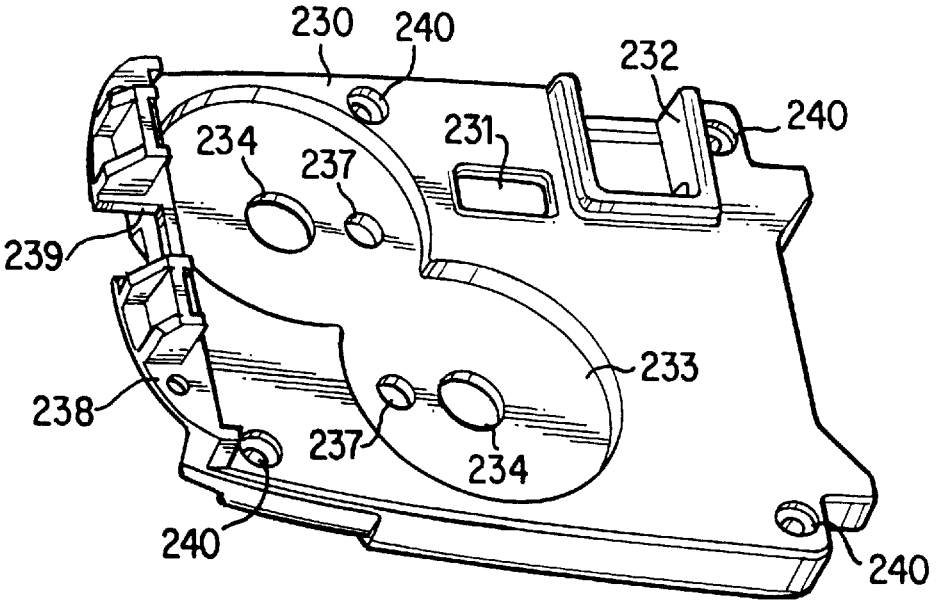
Figure 8A:
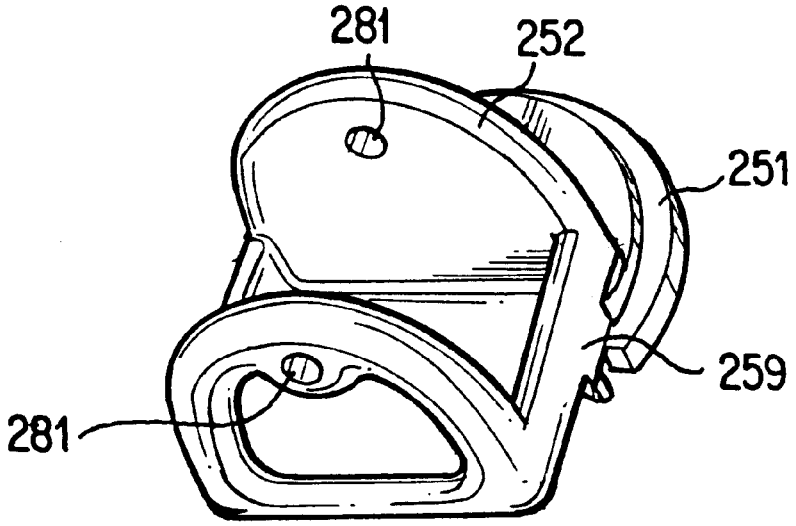
FIGS. 8A and B are bottom and top perspective views, respectively, of the first wheel gear bracket shown in FIG. 3B.
Figure 8B:
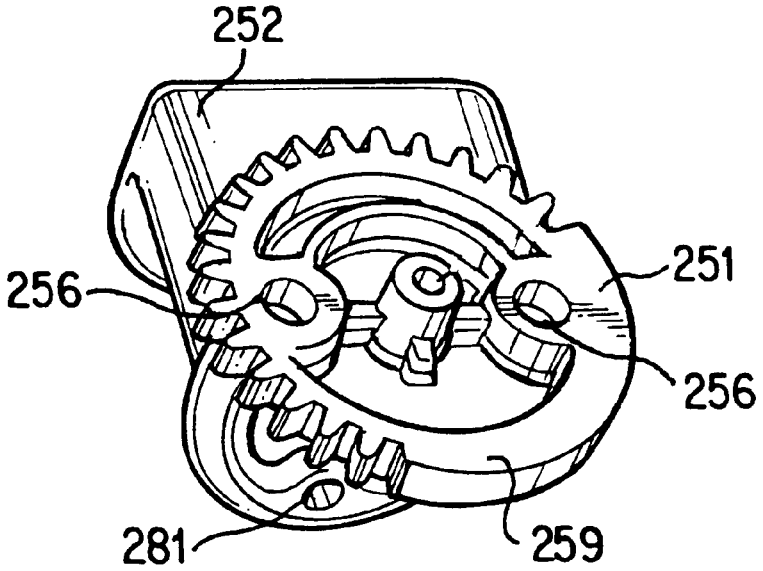
Figure 9A:
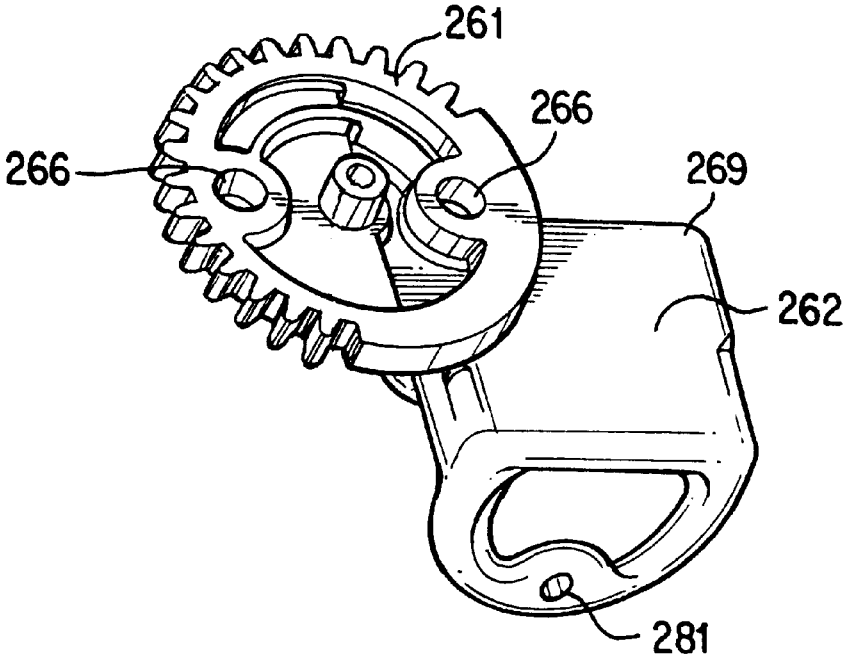
FIGS. 9A and B are top and bottom perspective views, respectively, of the second wheel gear bracket shown in FIG. 3B.
Figure 9B:
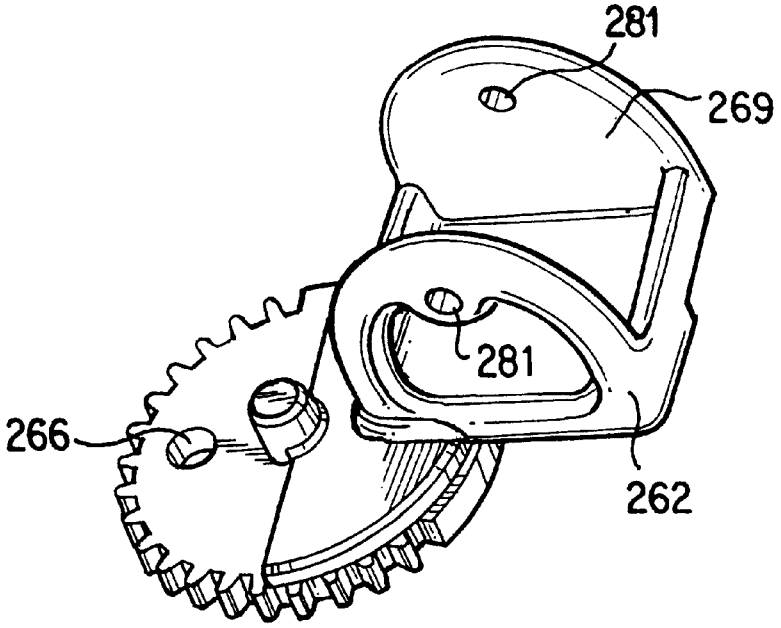
Figure 10A:
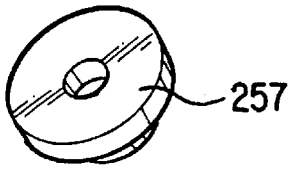
FIGS. 10A and B are first and second perspective views of the washer of the front wheel assembly shown in FIG. 3B.
Figure 10B:
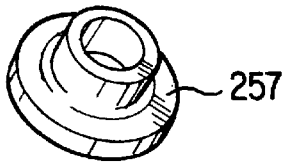

A gear housing 233 is provided in the rear assembly lower housing 230 to retain a first wheel gear 251 and a second wheel gear 261 in a plane parallel to the sole 111 of the shoe 100. As shown in FIGS. 7A–B, gear housing 233 is configured as a "figure 8," with gear axis apertures 234 extending through the housing at the center of each circle of the "figure 8." The gear housing 233 configuration retains the two wheel gears in rotative engagement with each other at the bottom of the skate 1. As will be explained in more detail later, latch lock apertures 237 located in the gear housing 233 provide a throughway for latch locks 274 to pass through the rear assembly lower housing 230 and contact the gears to lock them at a pre-set position.

A ledge 238 is located at the rearmost portion of the rear assembly lower housing 230 for connection to a reverse spinning brake 800. A brake lever opening 239 is located in ledge 238 to provide clearance for brake lever 803.

Finally, the rear assembly lower housing 230 and the rear assembly upper housing 210 can be connected together by screws or other fasteners. Apertures 240 are provided in the rear assembly lower housing for guiding the screws to the screw mounts 215 in the rear assembly upper housing 210.

Referring to FIGS. 3A–B and 8A–B, wheel and gear brackets embodying the principles of the invention will now be described. Rear wheel assembly 250 and a front wheel assembly 350 are similarly configured. Rear wheel assembly 250 includes a first wheel gear bracket 259, which is identical to a first wheel gear bracket 359 of front wheel assembly 350. Rear wheel assembly 250 also includes a second wheel gear bracket 269, which is identical to a second wheel gear bracket 369 of front wheel assembly 350.

In rear wheel assembly 250, first wheel gear bracket 259 is located closer to the rear of the skate 1 and to a first side of the skate 1 than is the second wheel gear bracket 269. However, in the front wheel assembly 350, the first wheel gear bracket 359 is located closer to the front of the skate 1 than is the second wheel gear bracket 369 and is also located further from the first side of the skate 1 than is the second wheel gear bracket 369. Front wheel assembly 350 is thus identical to the rear wheel assembly 250 except that it is rotated 180° and located on the front assembly lower housing 320 rather than the rear assembly lower housing 230 of the skate 1.

Figure 11A:
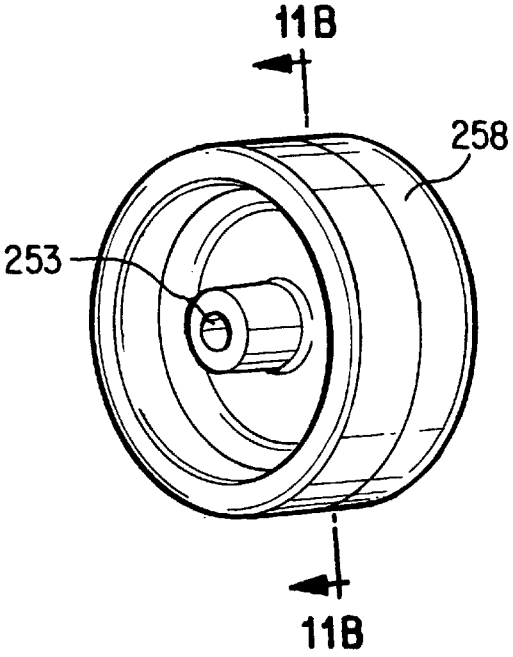
FIG. 11A is a perspective view.
Figure 11B:
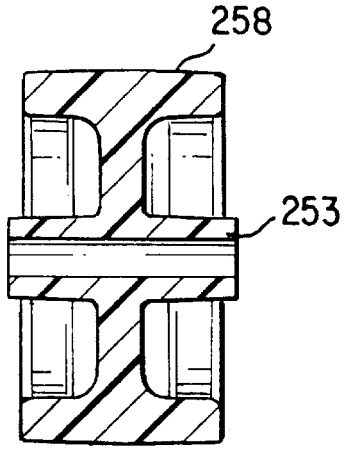
FIG. 11B is a cross-sectional view taken along line 11B—11B of FIG. 11A, of one of the wheels shown in FIG. 3B.

Each of the four skate wheels 258, 268, 358 and 368 are identical, and shown in FIGS. 11A–B.

First wheel gear bracket 259 includes a first wheel gear 251 and an integrally formed first bracket 252. First bracket 252 is U-shaped and holds the wheel 258 therein by an axle 280 that extends between the arms of the U-shaped bracket spanning wheel aperture 253 and is retained in wheel axle apertures 281 in the first gear bracket 252. First gear 251 includes two latch lock indents 256 that selectively lock with latch lock extensions 274 protruding from the rear wheel latch 270. The latch lock indents 256 on the first gear 251 are located 180 apart and at positions such that when the wheel 258 connected to the first wheel gear bracket 259 is in either an in-line skate configuration or a conventional roller skate configuration, the latch lock indent will be located beneath, and lockable with a latch lock extension 274 to lock the gears at the selected configurations.

Similarly, the second wheel gear bracket 269 includes a second gear 261 and second bracket 262. The second gear 261 also has two latch lock indents 266 that act in conjunction with the rear wheel latch 270 in the same manner as described above for the first gear latch lock indents.

The configuration of the first and second U-shaped brackets 252 and 262 with respect to the first and second gears 251 and 261, and the relative placement of the centers of the two gears enables the skate's convertibility between an in-line configuration and a conventional roller skate configuration. As shown in FIGS. 8A–9B, the second gear 261 can be a wheel gear that is attached to the second bracket 262 such that the gear is coplanar with the bottom of the U-shaped portion of the bracket 262. Second gear 261 has a rotational axis that is perpendicular to, but offset from, the rotational axis of the second wheel 268. In contrast, the first gear 251 has a rotational axis that intersects with, and is perpendicular to, the rotational axis of the first wheel 258. A comparison of FIGS. 8B and 9A makes clear the configurational difference between first wheel gear bracket 259 and the second wheel gear bracket 269.

First and second wheel gear brackets 259 and 269 are mounted for rotation within gear housing 233 by gear mounting screws 255 and 265, which pass through washers 257 and 267 (mounted in aperture 234) and engage brackets 252 and 262. The teeth of the first and second gears mesh, linking the first and second gear brackets 259 and 269 for rotation with respect to each other when turned.

The gears are positioned in the housing such that they can be locked in position by the rear wheel latch 270 in a conventional roller skate configuration. The gears can be turned by depressing a latch control button 271 while grasping one of the wheels 258, 268 and turning. When the latch is released and one of the gears is turned 180, both the first and second gear brackets 259 and 269 are turned 180 to change the position of the attached wheels between the conventional roller skate configuration and the in-line skate configuration. The wheels 258 and 268 are then locked in place again by the rear wheel latch 270. The rear wheel latch 270 automatically locks the wheels in one of the specific configurations once the wheels have been turned 180 or otherwise reach their next configuration.

Figure 12A:
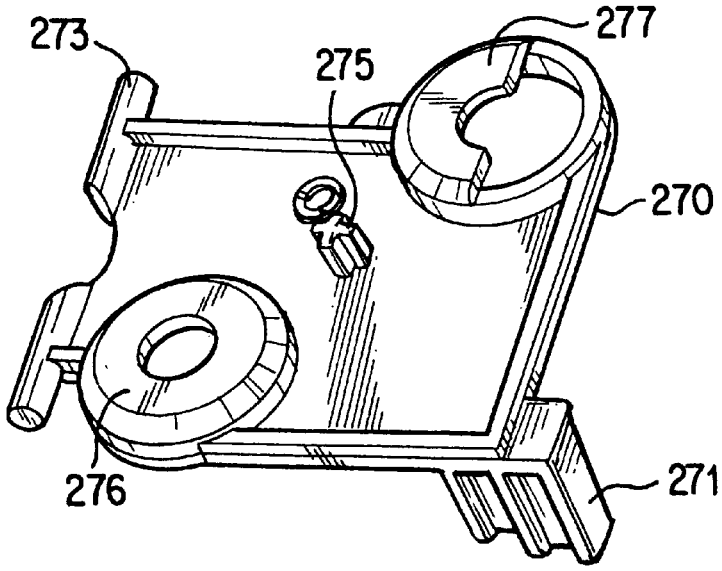
FIGS. 12A and B are top and bottom perspective views, respectively, of the latch mechanism shown in FIG. 3B.
Figure 12B:
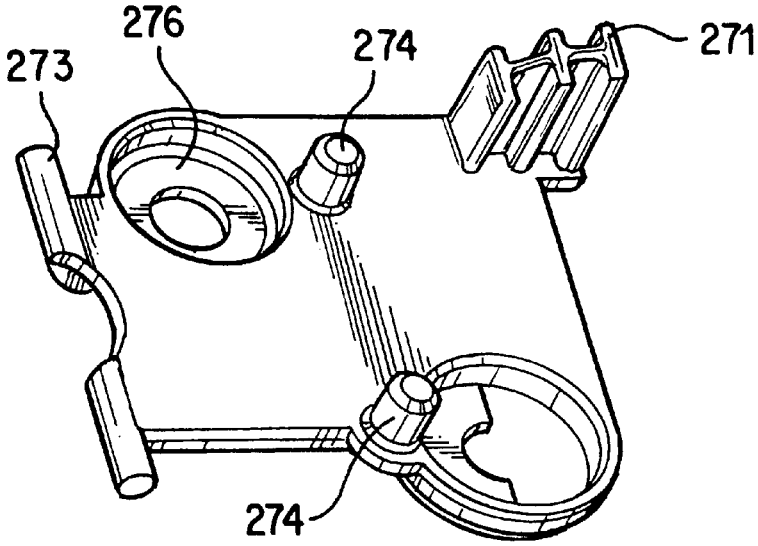

Referring to FIGS. 12A–B, the latch will now be more specifically described. The rear wheel latch 270 is configured as a plate with first and second gear cavities 276 and 277 that accommodate washers 257 and 267. The rear wheel latch 270 is hinged to the rear assembly lower housing 230 via a hinge pivot 273 that rides in a latch hinge joint 235. A latch control button 271 extends from an end of the rear wheel latch 270 opposite the hinge pivot 273 and through wheel latch aperture 231 in the rear assembly lower housing 230. Rear wheel latch 270 can be moved by depressing the latch control button 271 and rotating rear wheel latch 270 about the hinge pivot 273. Latch posts 274 provided on the bottom surface of the rear wheel latch 270 mate with the latch indents 256 and 266 located on the upper surface of the first and second gears 251 and 261, respectively. When mated, the first and second gears are locked at a specific rotational position coinciding with either an in-line skate configuration or a conventional skate configuration.

In operation, the skate is converted between the different configurations by depressing the latch control button 271 to rotate the rear wheel latch 270 and withdraw the latch lock extensions 274 from the latch lock indents 256 and 265 in the first and second gears 251 and 261. The first and second gears 251 and 261 are then rotated by turning one of the wheels 258, 268 (which causes both wheels to turn). The lock extensions 274 ride on the top surfaces of the first and second gears 251 and 261 during rotation. Once the wheels are aligned in either the in-line skate configuration or the conventional roller skate configuration, the latch lock indents 256 and 266 on the top surface of the gears 251 and 261 align with the latch lock extensions 274. A latch spring 272 urges the latch to rotate downwardly about the hinge pivot 273 to cause the latch lock extensions 274 to extend into the latch indents 256 and 266 in each of the first and second gears. Accordingly, rear wheel latch 270 automatically locks the wheels into one of the specific configurations when the wheels are rotated into that configuration.

Figure 15A:
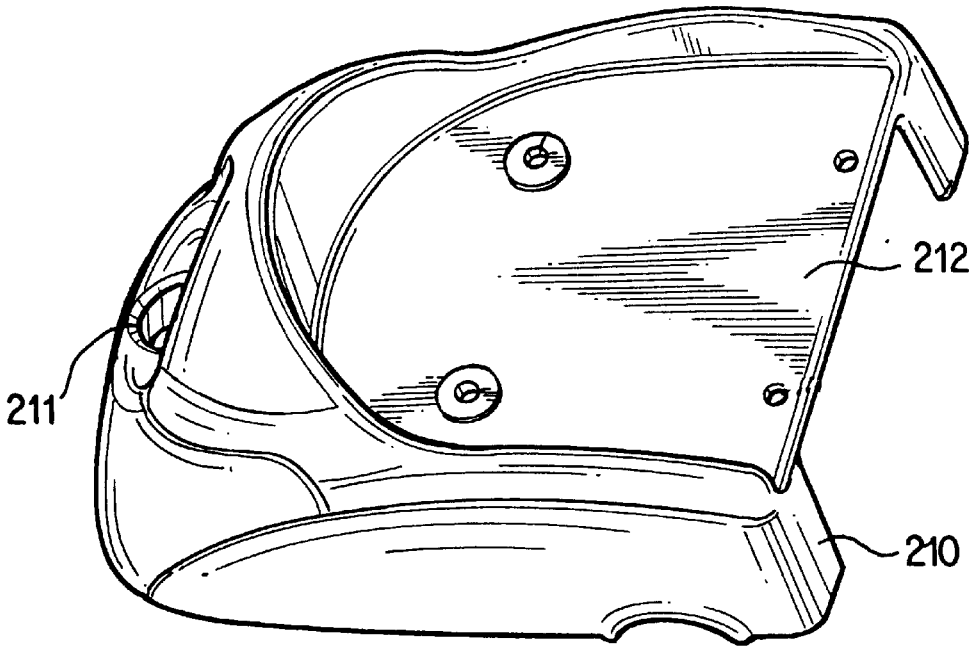
FIGS. 15A and B are top and bottom perspective views, respectively, of the rear assembly upper housing shown in FIG. 3A.
Figure 15B:
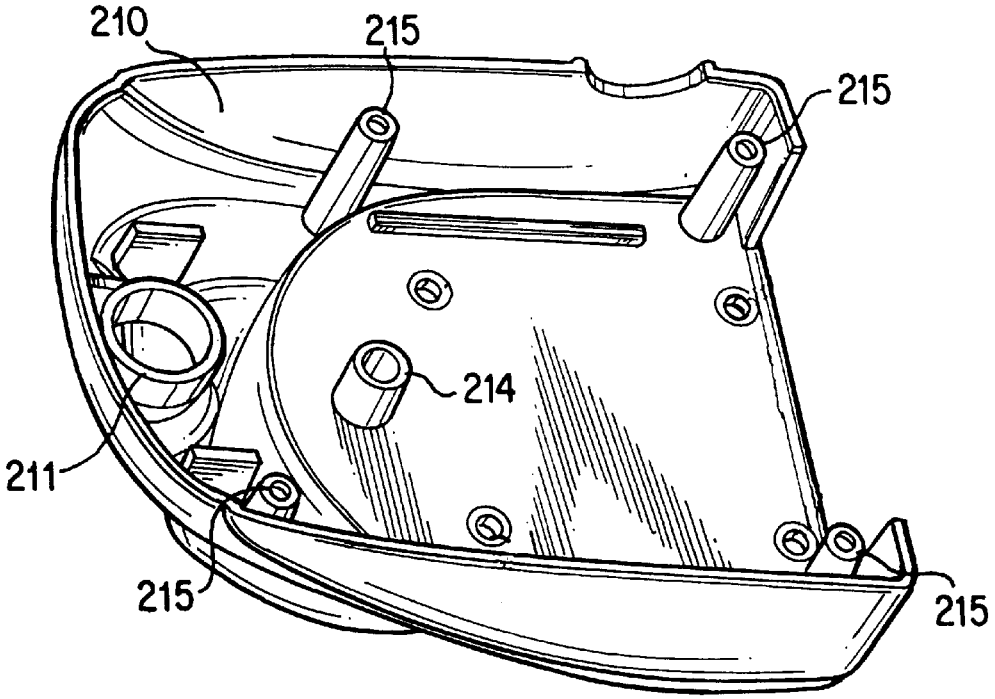
Figure 16A:
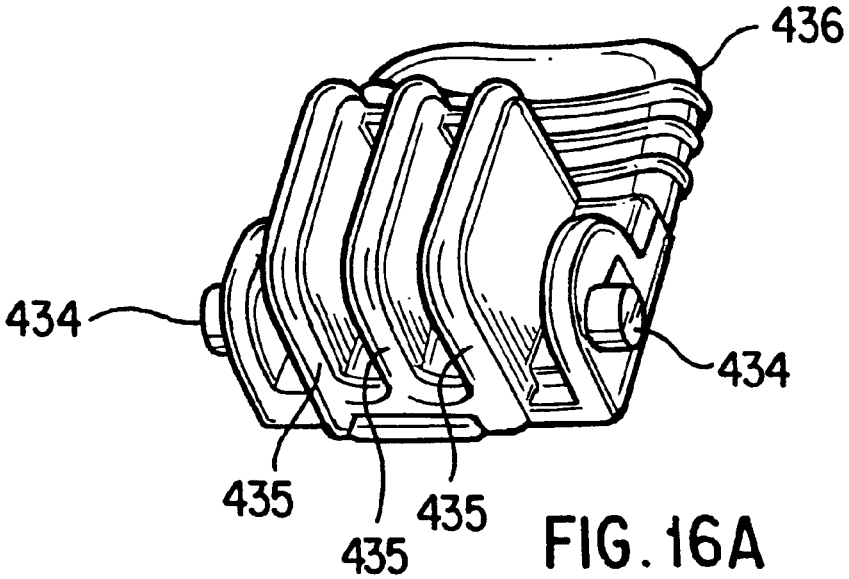
FIGS. 16A and B are top and bottom perspective views, respectively, of the length lock shown in FIG. 3B.
Figure 16B:
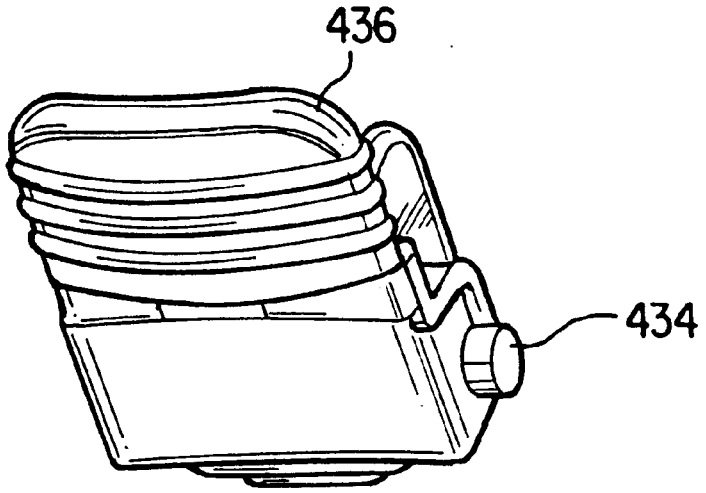
Figure 17A:
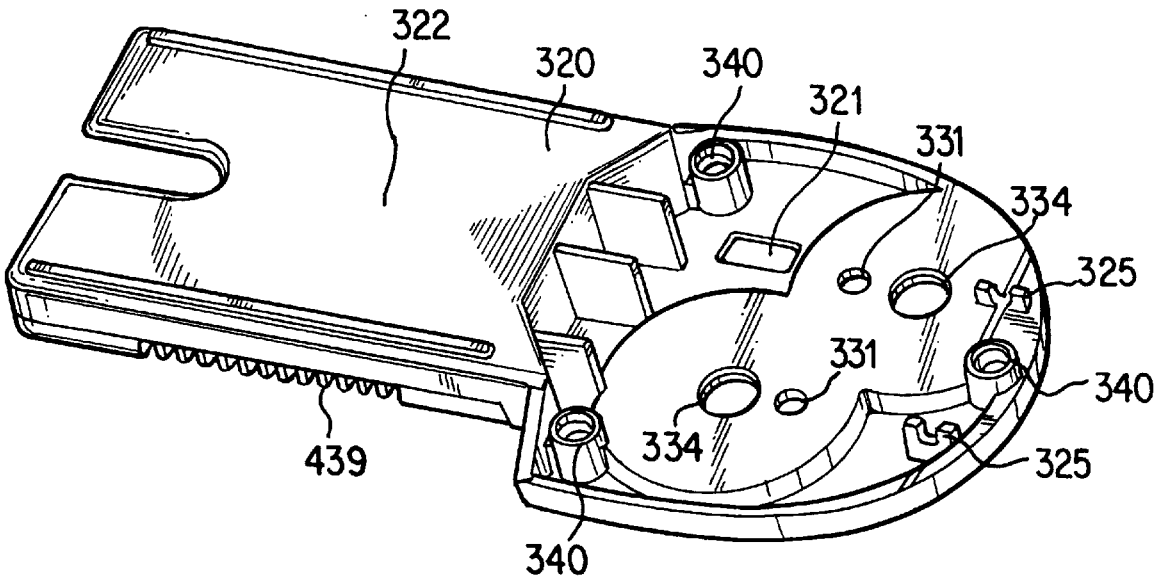
FIGS. 17A and B are top and bottom perspective views, respectively, of the front assembly lower housing shown in FIG. 3B.
Figure 17B:
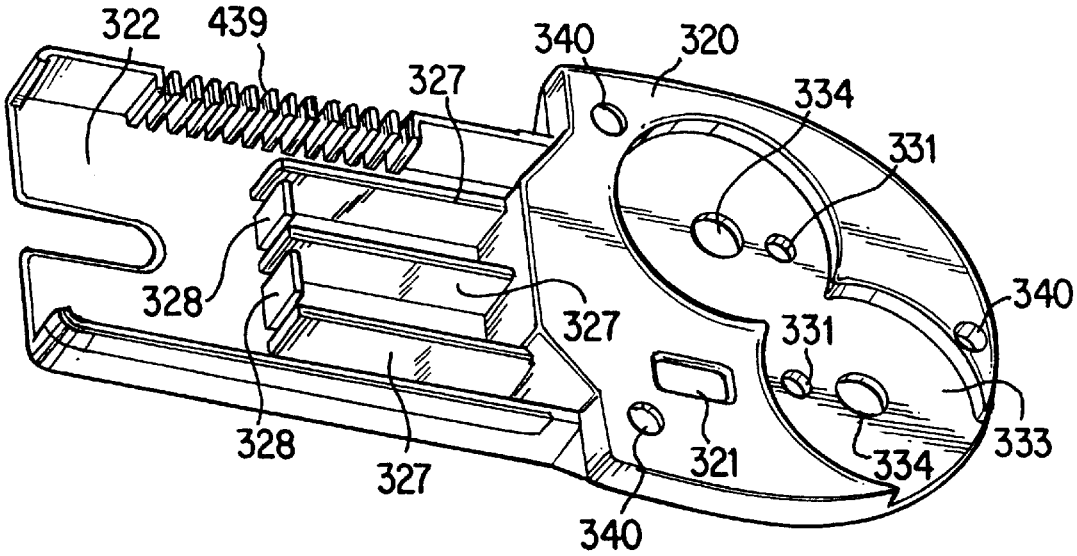

As shown in FIG. 15B, the rear assembly upper housing 210 may include a spring guide 214 that acts in cooperation with spring post 275 located on the rear wheel latch 270 to align the spring 272 and ensure that an accurate and predictable locking force returns the rear wheel latch 270 to its locked position. Alternatively, spring 274, spring guide 215, and spring post 275 can be replaced with a leaf spring integrally formed with the back of rear wheel latch 270.

Front assembly 300 of the convertible skate 1 will now be described with reference to FIGS. 3A–B and 17A–B. Front assembly 300 differs only slightly from rear assembly 200, and can utilize identical parts to facilitate economical manufacture of the skate. Wheels 358, 368, rear wheel latch 270, and first and second wheel gear brackets 359, 369 are identical to those of the rear assembly 200 as described above and will not be described further here.

Front assembly 300 includes a front assembly upper housing 310 that connects with a front assembly lower housing 320. Front assembly upper housing 310 includes a toe cap platform 311 to which toe cap 130 is secured. A toe cap indent 312 mates with toe cap tab 131 to ensure alignment of the toe cap 130 with the front assembly upper housing 310 during manufacture. A spring guide can be located on the lower surface of the front assembly upper housing 310 to guide a latch spring in a manner similar to that described above for the rear assembly upper housing 210. The front assembly lower housing 320 includes a latch aperture 321 and latch hinge joint 325 that perform the same functions as described above for the corresponding structures in the rear assembly lower housing 230. Gear housing 333 is configured identically to gear housing 233 in the rear assembly lower housing, and includes latch lock apertures 331 and gear mount apertures 334. Connection apertures 340 may be provided in the front assembly lower housing 320 to mate with and join to the front assembly upper housing 310. As previously described, lengthening extension 322 can slidingly engage the rear assembly lower housing 230 to adjustably connect front assembly 300 to rear assembly 200. Channel walls 327 and channel limits 328 guide the front assembly when it is extended from or withdrawn into the rear assembly to change the size of the skate shoe. Teeth 439 acting in conjunction with the length lock 436 allow the two assemblies to be locked together at selected positions along the length of the lengthening extension 322.

Shoe 100 includes a sole portion 111 for attachment via screws or other suitable fasteners to the rear assembly upper housing on its lower side and for accommodating a child's foot on its upper side. Shoe 100 includes apertures 113 located around a front cuff for securing a strap 114 to the shoe 100. The right strap is a mirror image of the left strap. The straps can be made from any resilient durable material and are preferably formed in the shape of an "X" to secure a large portion of the open area between the left and right cuffs of the shoe 100. A strap cover is placed over two right extensions of the strap and is secured to the shoe 100 by strap connector 112. Two strap lever holders 115 are connected to the shoe 100 by rivets 117. A strap lever 116 is pivotably connected to the strap lever holder 115 to create throughways for the two left extensions of the strap. Thus, strap lever 116 can be pivoted towards strap lever holder 115 to wedge onto the extension of strap 114 and secure a skater's foot within shoe 100. Apertures can be provided at the end of the outward extensions of the strap to provide a finger grip for a skater or other person to pull and tighten the strap.

As stated previously, convertible skate 1 may include a reverse spinning brake 800 that prevents the skate from rolling backwards. As shown in FIG. 3B, reverse spinning brake 800 includes a brake housing 802 mounted to the back of rear assembly lower housing 230. In the illustrated embodiment, brake 800 includes a knurled brake rod 801 that is disposed in brake housing 802 adjacent wheel 258 (or wheels 258 and 268 depending on the skate configuration). Brake rod 801 is captured within a tapered slot 809 and rides within channel 808 of brake housing 802. Accordingly, when the rearmost wheel(s) spin in the forward rolling direction, the brake rod is pushed upwardly and freely moves towards the open end of tapered slot 809 with little or no friction on the wheel(s). However, if the skate begins to roll backwards, brake rod 801 is urged downwardly into the narrowing end of tapered slot 809. Brake rod 801 then locks in the tapered slot 809 and, as a result of the friction between the brake rod 801, tapered slot 809 and the wheel (s), wedge against the wheel(s) to brake the reverse spinning motion.

Figure 13A:
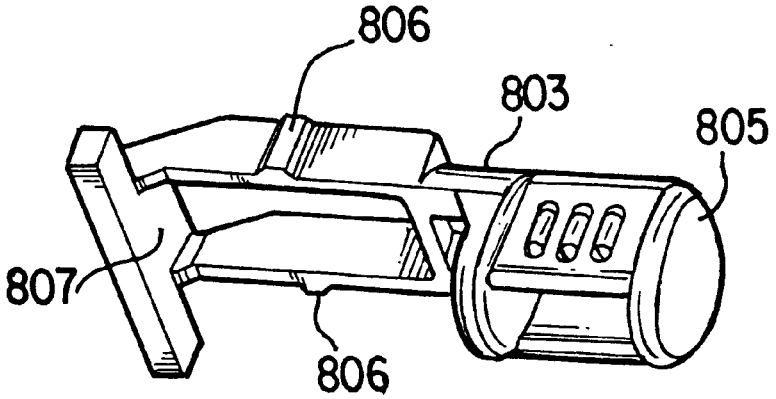
FIGS. 13A and B are top and bottom perspective views, respectively, of the brake lever shown in FIG. 3B.
Figure 13B:
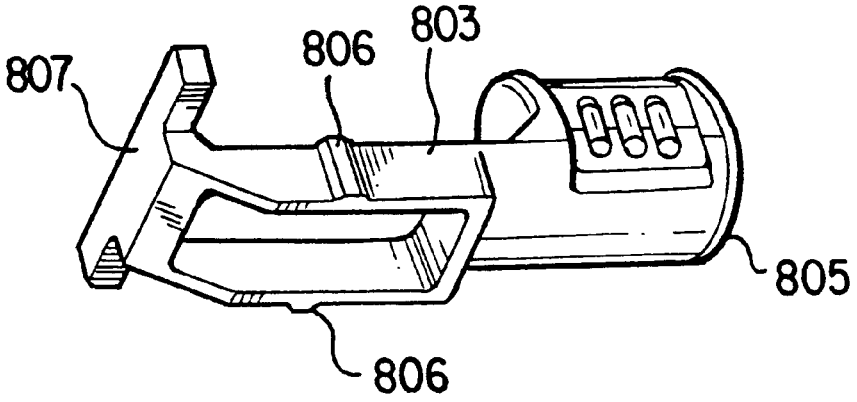
Figure 14A:
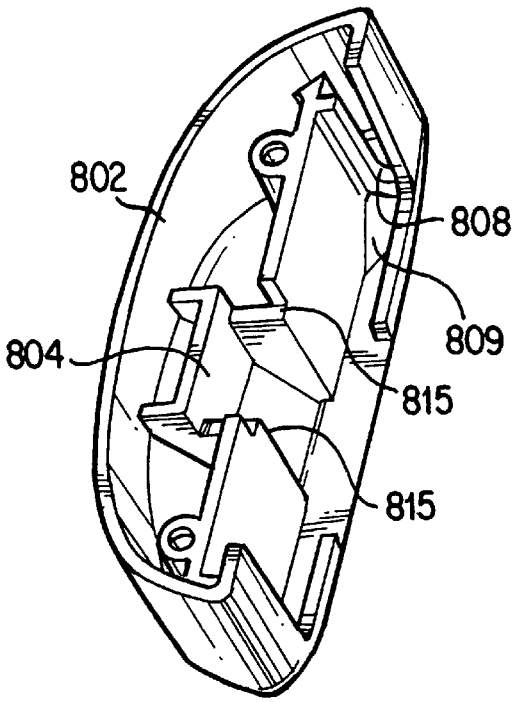
FIGS. 14A and B are top and bottom perspective views, respectively, of the brake housing shown in FIG. 3B.
Figure 14B:
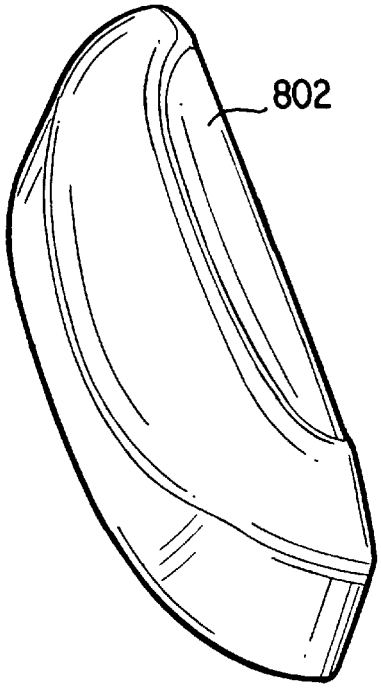

A brake lever 803 is provided within a brake lever opening 804 of brake housing 802 to selectively engage and disengage the brake. As shown in FIGS. 13A–B, brake lever 803 includes a pull knob 805, a brake rod lifting portion 807, and two protrusions 806 on opposite sides of the lever. To disengage the brake, knob 805 is pulled upwardly causing lifting portion 807 to engage and raise the brake rod 801 out of engagement with the rear wheel(s). The brake lever is locked in the raised position by engagement of protrusions 806 with shelf 815, as shown in FIG. 14A. In the raised position, skate 1 operates in a "free-wheeling" mode, and brake 800 does not inhibit backward rotation of the wheels.

Figure 18:
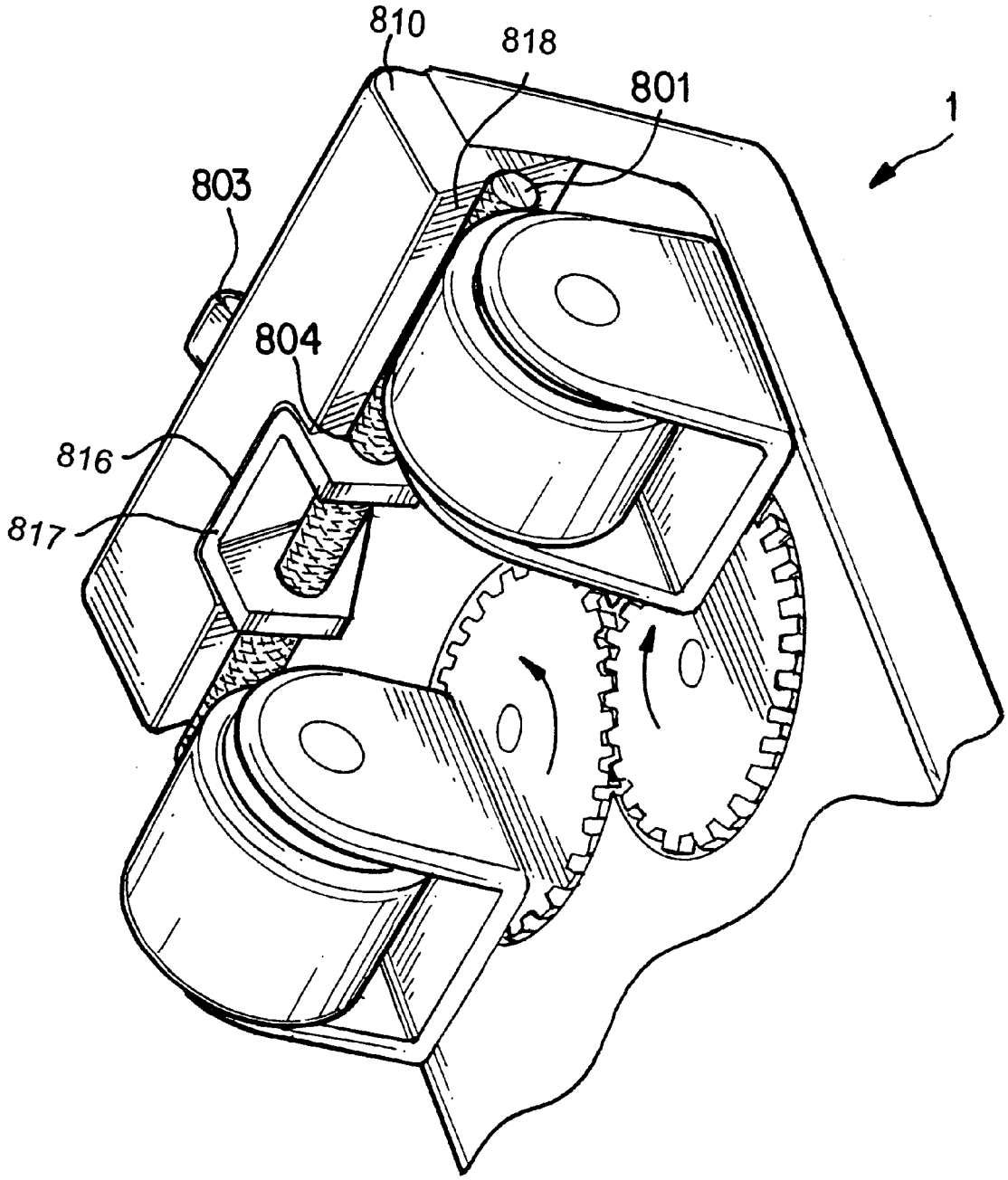
FIG. 18 is a perspective view of the reverse spinning brake shown in FIG. 3B.

An alternative embodiment of the reverse spinning brake is shown in FIG. 18. In this embodiment, brake lever 803 extends through a central opening 816 in the brake housing 810. The lever 803 includes a U-shaped portion 817 that has an aperture in each of its arm portions to retain the knurled bar 801 adjacent the wheel(s). Substantial tolerance is built into the central opening 816 in the housing 810 such that the knurled bar 801 will ride up the ramp portion 818 of the housing 810 when the wheels rotate in a forward direction, and will ramp downwards and eventually be wedged between the wheel(s) and the housing 810 to brake the wheel(s) when they are spinning in a reverse direction. Brake lever 803 can be pulled and locked out of the housing 810 to retain the knurled bar away from the wheel(s) and disengage the reverse spinning brake feature.

The first wheel 258 is always located at the same distance away from the back of the skate 1, regardless of whether the rear wheel assembly is disposed in an in-line or conventional roller skate configuration. As a result, the embodiments of the reverse spinning brake in accordance with the invention can operate in all configurations of the wheels, including the in-line skate configuration, the conventional roller skate configuration, and the two hybrid configurations.

Although the invention has been described with reference to a convertible skate that can be switched between an in-line configuration, a conventional roller skate configuration, and two hybrid configurations, it is not beyond the scope of the invention to incorporate more than two pairs of convertible wheels or even a single pair of convertible wheels that will result in different wheel configurations for the convertible skate.

In addition, the number of configurations for each pair of wheel assemblies could also be greater than two. The invention could include a wheel bracket that can rotate with respect to its associated gear and be lockable relative to that gear. Accordingly, the number of configurations for the wheel assemblies would depend on the number of locking positions between the wheel brackets and their associated gears as well as the number of locking positions between the latch and the rotary gear.

The components of the convertible skate can be formed of any suitable material known to the artisan, including plastics, rubbers, carbon composites, thermoplastic or thermosetting polymers, or other lightweight, durable materials.

A wheel gear is disclosed for use in the wheel gear brackets of the convertible skate invention. However, other types of rotary platforms besides a wheeled gear could be provided to accomplish the objectives of the invention, for example, a set of friction locked wheels.

Although in the preferred embodiment of the invention the skate is described as a child's skate, the inventive concepts disclosed herein can be utilized in skate devices for adults. Moreover, the reverse spinning brake of the invention can be adapted for use with an adult in-line skate or conventional roller skate. In addition, ball bearing type wheels and a ski-binding type shoe can be used in accordance with the invention to provide a convertible skate for use by adults and well trained skaters.

The reverse spinning brake embodiments disclosed herein are incorporated into the convertible skate adjacent the rear wheel(s). However, it is contemplated that the reverse spinning brake could be located at other positions on the skate, including adjacent the front or possibly middle wheel(s). In addition, the reverse spinning brake could be configured to include a full-stop mode in which the brake locks the wheel(s) from rotation in any direction. Such a feature would allow a child to "walk" the skates.

The latch mechanism of the invention is disclosed as requiring two buttons that extend through the lower housings of the skate to separately unlock each pair of front and rear wheels. Other embodiments could include a latch that requires only one button extending through the lower housing that can unlock all wheels of the skate for conversion to a different configuration, or any other suitable latch.

What is claimed is:

1. A roller skate comprising:

a skate shoe;

a first rotary platform coupled to said skate shoe for rotational movement with respect to said shoe about a first platform rotational axis between a first rotational position and a second rotational position;

a second rotary platform coupled to said skate shoe for rotational movement with respect to said shoe about a second platform rotational axis between an initial rotational position and a subsequent rotational position;

a first front wheel mount fixed and rotatable with said first rotary platform;

a second front wheel mount fixed and rotatable with said second rotary platform;

a first wheel coupled to said first front wheel mount for rotation about a first wheel axis and having an initial position; and a second wheel coupled to said second front wheel mount for rotation about a second wheel axis;

whereby rotation of said first rotary platform from said first rotational position to said second rotational position changes the position and orientation of said first wheel with respect to said shoe such that said first wheel is rotated from its initial position.

2. The roller skate of claim 1, whereby rotation of said second rotary platform from said initial rotational position to said subsequent rotational position changes the position and orientation of said second wheel with respect to said shoe.

3. The roller skate of claim 2, wherein said first rotary platform is coupled to said second rotary platform whereby rotation of said first rotary platform rotates said second rotary platform.

4. The roller skate of claim 3, wherein said first rotary platform includes gear teeth, and said second rotary platform includes gear teeth that mesh with said gear teeth of said first rotary platform to cause said first and second rotary platforms to rotate synchronously.

5. The roller skate of claim 2, wherein said first platform rotational axis is offset with respect to said second platform rotational axis laterally and longitudinally with respect to said shoe.

6. The roller skate of claim 2, further comprising:

means for selectively locking said first and second rotary platforms in said first rotational position and initial rotational position, respectively, and said second rotational position and subsequent rotational position, respectively.

7. The roller skate of claim 2, wherein when said first and second rotary platforms are in said respective first and initial rotational positions, said first and second wheel axes are parallel and not coaxial, and when said first and second rotary platforms are in said respective second and subsequent rotational positions said first and second wheel axes are coaxial.

8. The roller skate of claim 1, further comprising:

a reverse spinning brake mechanism coupled to said skate shoe and disposed to operatively engage said first wheel in said first rotational position of said first rotary platform to inhibit rotation of said first wheel in a selected rotational direction of said first wheel about said first wheel axis.

9. The roller skate of claim 8, wherein said reverse spinning brake mechanism is disposed to operatively engage said first wheel in said second rotational position of said first rotary platform.

10. The roller skate of claim 9, wherein said reverse spinning brake mechanism includes a knurled rod disposed approximately parallel to said first wheel axis and mounted to be wedged against an outer surface of said first wheel when said first wheel is rotated about said first wheel axis in a first rotational direction.

11. The roller skate of claim 1, wherein said first rotary platform is first and second rotational positions are offset by approximately 180° about said first platform rotational axis.

12. A method for changing from a first configuration to a second configuration a roller skate having a shoe, a first wheel coupled to said shoe for rotation about a first wheel axis, and a second wheel coupled to said shoe for rotation about a second wheel axis, comprising the steps of:

rotating said first wheel about a first conversion axis from a first wheel initial position to a first wheel final position; and rotating said second wheel about a second conversion axis from a second wheel initial position to a second wheel final position, wherein said step of rotating includes said conversion axes remaining parallel, such that said wheels disposed in said initial positions rotate in a first direction about said wheel axes in response to forward movement of said skate, and said wheels disposed in said final positions rotate in a second opposite direction in response to forward movement of said skate.

13. The method for changing a skate of claim 12, further comprising:

locking said wheels at said final positions.

14. The method for changing a skate of claim 12, wherein said conversion axes are perpendicular to said wheel rotational axes.

15. The method for changing a skate of claim 12, wherein said wheel axes are collinear in said final positions.

16. A convertible skate, comprising:

a skate shoe;

a first wheel platform coupled to said skate shoe and movable with respect to said skate shoe between a first position and a second position;

a second wheel platform coupled to said skate shoe and movable with respect to said skate shoe between an initial position and a subsequent position;

a first wheel coupled to said first wheel platform for rotation about a first wheel axis and for movement with said first wheel platform between said first position and said second position;

a second wheel coupled to said second wheel platform for rotation about a second wheel axis and for movement with said second wheel platform between said initial position and said subsequent position; and means for moving said first wheel platform from said first position to said second position, wherein said first wheel axis when in said first position is collinear with said first wheel axis when in said second position.

17. The convertible skate of claim 16, wherein said means for moving said first wheel platform includes a structure connecting said first wheel platform to said skate shoe for rotational movement with respect to said shoe about a first wheel platform rotational axis between said first position and said second position.

18. The convertible skate of claim 16, further comprising:

means for moving said second wheel platform from said initial position to said subsequent position, wherein said second wheel axis when in said initial position is not collinear with said second wheel axis when in said subsequent position.

19. The convertible skate of claim 18, wherein said means for moving said first and second wheel platforms include gear teeth located on a periphery of each of said first and second wheel platforms, said gear teeth on said first wheel platform meshing with said gear teeth located on said second wheel platform to move the first and second wheel platforms simultaneously.

20. The convertible skate of claim 16, further comprising:

means located on said shoe for preventing said first wheel from spinning in a reverse direction about said first wheel axis and for allowing said first wheel to spin in a forward direction opposite said reverse direction.

21. The convertible skate of claim 16, further comprising:

means located on said shoe for selectively locking said first wheel platform in said first position and second position.

* * * * *